United States Patent [19]

Christison et al.

[11] 4,118,013

[45] Oct. 3, 1978

[54] SELF-ENERGIZING WINCH BRAKE AND DRIVE

[75] Inventors: Sommerville Grant Christison, Delta; John Edwin Magnuson, Surrey; Wing Chong Tham, Nanaimo, all of Canada

[73] Assignee: PACCAR Of Canada, Ltd., Ste-Therese, Canada

[21] Appl. No.: 776,844

[22] Filed: Mar. 14, 1977

[51] Int. Cl.[2] ..... B66D 1/08

[52] U.S. Cl. ..... 254/187.5; 192/8 R

[58] Field of Search ..... 254/167, 168, 154, 186 R, 254/150 R, 150 FH, 187.1, 187.4, 187.5, 187.8; 188/187, 134, 166, 167; 192/8 R

[56] References Cited

U.S. PATENT DOCUMENTS

| | | | |
|---|---|---|---|
| 710,757 | 10/1902 | Coleman et al. | 188/82 |
| 2,783,861 | 3/1957 | Jungles | 192/8 R |
| 2,925,157 | 2/1960 | Davis | 192/8 R |
| 3,519,247 | 7/1970 | Christison | 254/150 R |
| 3,915,022 | 10/1975 | Walton | 192/8 R |

*Primary Examiner*—Robert G. Sheridan
*Assistant Examiner*—D. Underwood
*Attorney, Agent, or Firm*—Seed, Berry, Vernon & Baynham

[57] ABSTRACT

An input shaft is provided with circumferentially spaced ramps which confront opposed ramps on a coaxially aligned ramp shaft. The ramp shaft is provided with a sun gear which can rotate only through a one-way clutch and a plurality of brake discs. The sun gear drives a drum through a planetary drive system. The ramps each are provided with a shoulder. Balls are trapped between the ramps. Rotation of the input shaft in a hoisting direction drives the ramp shaft bypassing the brake through the one-way clutch. Thus the drum is rotated by the torque through the balls and shoulders. The brake discs are set by springs so that the load remains braked when hoisting is stopped. In the power down condition the input shaft rotates relative to the ramp shaft so that the balls move along the ramps spreading the shafts and compressing the springs so that the brake discs are released.

8 Claims, 5 Drawing Figures

SELF-ENERGIZING WINCH BRAKE AND DRIVE

BACKGROUND OF THE INVENTION

1. Field of the Invention

This invention pertains to hoisting winches of the type designed to lift and lower heavy loads, and more particularly, to self-energizing braking and drive systems for such winches.

2. Description of the Prior Art

Braking and planetary drive systems for hoisting winches are of the type, such that when the winch is driven in the hoisting or "up" direction the drum is rotated to lift the load. The power is generally provided by a hydraulic motor. When the motor is stopped a brake is automatically set to prevent the load from turning the drum. One procedure for allowing this one-way hoisting direction of the drum is through the use of an over-running clutch, that is, a clutch which allows rotation in one direction but does not allow rotation in the opposite direction. In hoisting winches it is known to overcome the brake when powering out a load in the load-lowering condition. In one technique this is done by running the hydraulic motor in the opposite direction and using hydraulic pressure to overcome springs on the braking discs to allow the winch drum to be rotated in the lowering condition. In these winches if the load, because of changes in static and dynamic friction, begins to accelerate and cause the drum to run faster than the hydraulic motor, then the hydraulic motor begins to act as a pump reducing its inlet pressure and thus reducing the pressure acting against the springs on the braking discs. This action automatically sets the brake to reduce the speed of the drum. There are problems using the hydraulic fluid as the means for overcoming the brakes. One of these problems, for example, is that the brake becomes sensitive to hydraulic back pressures in the hydraulic power system as well as sensitive to any other type of desirable pressure increases on the input side of the hydraulic pump.

SUMMARY OF THE INVENTION

It is an object of this invention to provide an improved self-regulating brake and drive mechanism for a hoisting winch.

It is another object of this invention to provide a mechanically actuated, self-regulating braking mechanism which is powered solely from the input torque of a hydraulically powered winch.

Basically these objects are obtained by providing on the input shaft of the winch a ramp flange having a plurality of circumferentially spaced ramps each with an end shoulder. Coaxially aligned with the input shaft is a ramp shaft having opposed ramps also each with a shoulder. A plurality of balls are seated between the opposed ramps so that rotation of the ramp flange in one direction will drive the ramp shaft through the balls which are seated against the shoulders of the ramps. Rotation in the opposite direction will cause the balls to roll along the ramps moving the ramp flange axially. The ramp shaft is provided with a sun gear that drives the drum through a planetary drive system. The sun gear can be locked against rotation in the lowering direction by braking discs and a one-way clutch. The sun gear can be rotated in the hoisting direction by allowing rotation relative to the brake discs through the one-way clutch. That is, rotating the input shaft in the hoist direction isolates the brake discs from the sun gear so that the sun gear can rotate the drum. Rotation of the input shaft in the lowering or opposite direction, however, moves the ramp flange against the braking force on the ramp shaft. The torque on the ramp flange rotates the flange relative to the ramp shaft, rolling the balls along the ramps, and forcing the ramp flange to the left in FIG. 1 to release the brake discs. The load will begin to be lowered and if the load accelerates due to changing friction conditions the ramp shaft will soon overtake the input speed of the motor so that the balls will return along the ramps to the opposite ends of the ramps allowing the springs to again set the brakes.

The advantages of this self-regulating braking and drive system are apparent. The system is dependent solely on input torque on the input shaft rather than hydraulic pressure to the motor. It is self-regulating in that the load will automatically be slowed when it begins to accelerate and run faster than the hydraulic motor. Since the brakes are set by springs the braking pressure can be accurately determined so that for overload conditions the brakes will slip rather than causing damage to the hoist, the cable, or the boom or crane upon which the hoisting winch is mounted.

DETAILED DESCRIPTION OF THE PREFERRED EMBODIMENT

Figure 1:
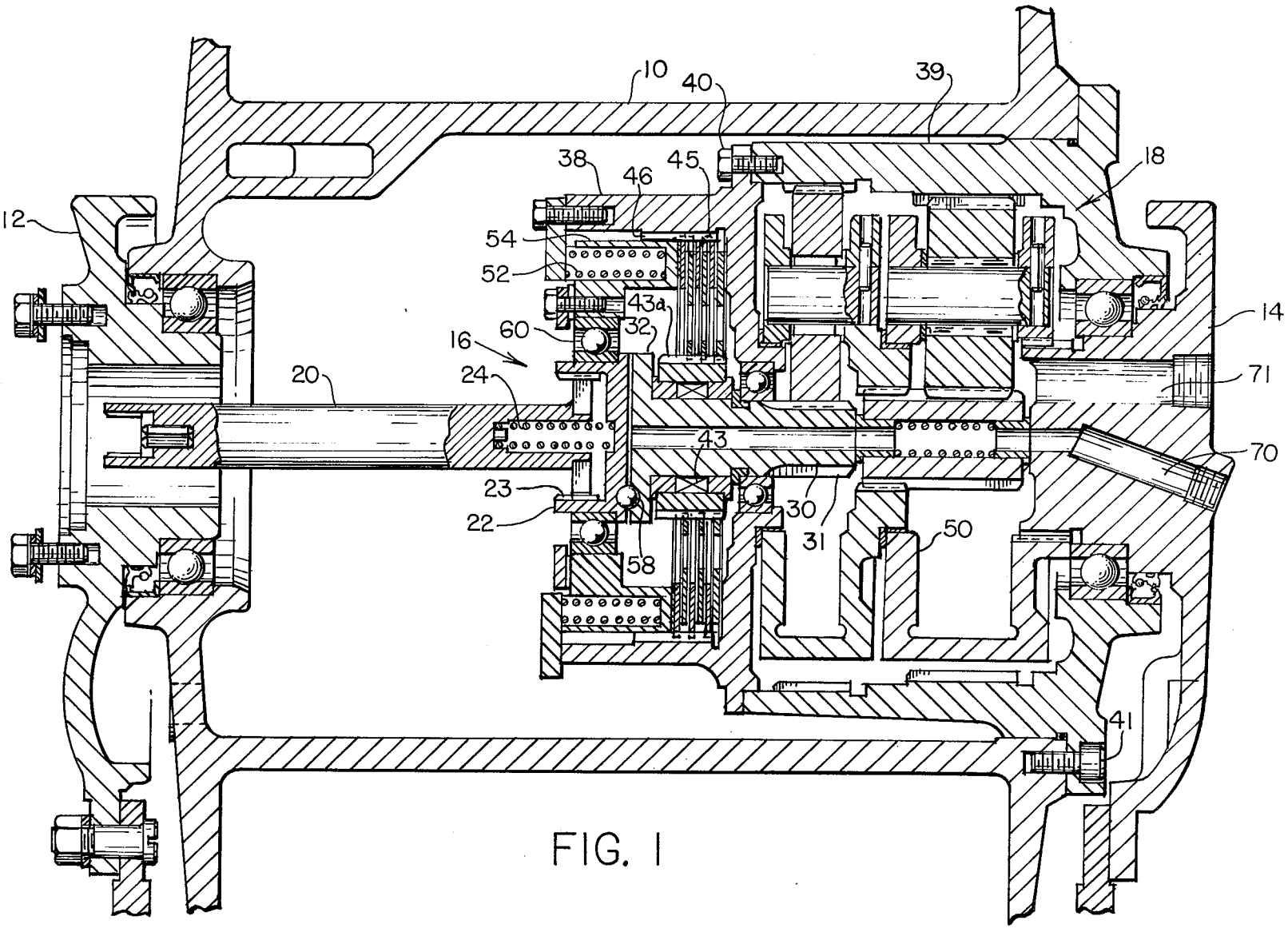
FIG. 1 is a section through a hoisting winch embodying the principles of the invention.
Figure 2:
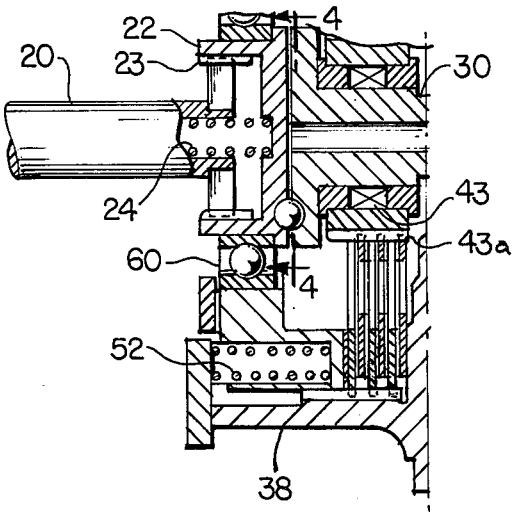
FIG. 2 is an operational schematic illustrating a fully braked condition.
Figure 4:
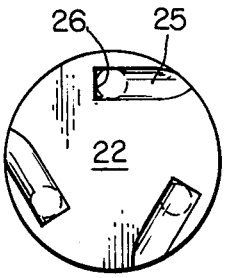
FIG. 4 is a fragmentary elevation looking in the direction of the arrows 4—4 in FIG. 2.

As best shown in FIG. 1 the hoisting winch includes a drum 10 rotatably mounted between stationary side plates 12 and 14. The hoisting winch is provided with a brake and drive assembly 16 and a planetary drive transmission 18. The brake and drive assembly 16 includes an input shaft 20 driven by any suitable hydraulic motor. A ramp flange 22 is connected to the input shaft by splines 23 thus allowing axial movement between the input shaft and the ramp flange. The face of the ramp flange 23 is best shown in FIG. 4 and includes a plurality of circumferentially spaced ramps 25 each of which are provided with a blocked end or shoulder 26. The ramps extend tangentially of the ramp flange. A spring 24 urges the ramp flange to the right in FIG. 1.

Figure 3:
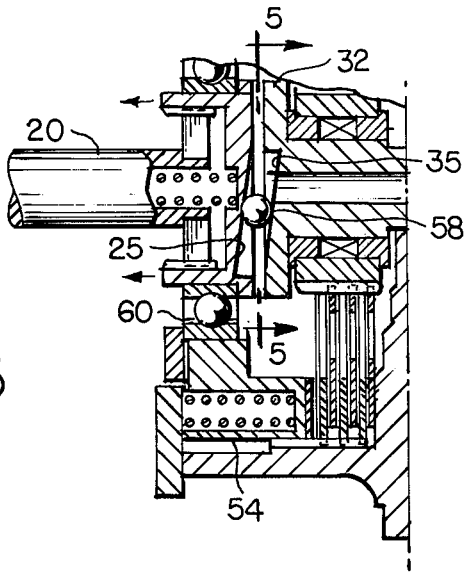
FIG. 3 is a schematic operational view illustrating the mechanism in a brake release condition.
Figure 5:
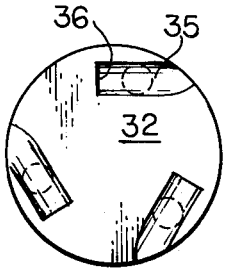
FIG. 5 is a fragmentary elevation looking in the direction of the arrows 5—5 of FIG. 3.

Coaxially aligned with the input shaft is a ramp shaft 30 having an integral primary sun gear 31 and a ramp end 32. The face of the ramp end is best shown in FIG. 5 and includes a plurality of circumferentially spaced ramps 35 each with an end shoulder 36. The ramps 35 are tangentially arranged around the end 32 and are in opposed confronting relation to the ramps 25 as best shown in FIG. 3.

The braking mechanism includes a brake housing 38 which is connected to an internal gear 39 by cap screws 40. The internal gear 39 is coupled to the drum 10 by cap screws 41. A one-way clutch 43 of a conventional type in which rotation is allowed between outer splines **43*a* and the ramp shaft 30 in one direction of rotation but which must move conjointly with the ramp shaft 30** in the other direction is provided. The splines are coupled to conventional sets of braking discs 45 which are meshed with splines 46 in the brake housing 38. Thus, if the brake is set and the clutch is locked in its direction of rotation the primary sun gear 31 will be locked to the internal gear. This locks the complete planet-reduction and since the final reduction planet carrier 50 is splined to the side plate 14 the drum will be prevented from rotating. This, of course, will prevent rotation of the drum to the full extent of the braking force available from the compression of the brake discs. The brake discs are compressed by springs 52 which push against a brake piston 54 that clamps the brake discs against the brake housing 38. The force capability of the springs thus determines the amount of overload before the drum will begin to slip relative to the brake discs.

The brake is released by driving the motor in a lowering rotational direction. When the ramp flange 22 is driven in a lowering direction by the motor, the balls 58 which are mounted in the ramps travel along the ramps in the ramp flange and in the ramp shaft end 32. This movement of the balls causes the ramp shaft and ramp flange to separate by movement of the ramp flange. The ramp flange engages a bearing 60 which contacts the brake piston 54. As the motor torque is increased, the force on the brake piston increases, to the left, as shown in FIG. 1, and removes part of the spring load that holds the brake discs in engagement. The torque increases until sufficient spring load is removed from the brake discs to allow the brake discs to slip and to drive the cable drum in a lowering direction. When pressure is reduced or removed from the hydraulic motor, the effective spring load is increased, causing the brake discs to reengage to slow down or stop the cable drum.

If the load on the cable drum tries to drive the hydraulic motor at a speed faster than the oil supply will permit, there will be a tendency for the sun gear 31 to rotate in a direction relative to the ramp flange 22. This will cause the balls to roll back down the ramps and cause the brake to engage.

The balls 58 are held in engagement with the ramp flange and the ramp shaft at all times by the coil springs 52. This ensures the correct relationship of the balls to the ramp slots at all times. When pressure is removed from the hydraulic motor, the springs force the ramp flange into full contact with the balls. Under these conditions the ball bearings 60 move away from the shoulder on the brake piston 54. This allows the brake springs to exert their full force on the braking discs without being restricted. A clearance is provided between the ball bearings and the shoulder on the brake piston to be about 0.030 to 0.035 inches.

Oil is circulated through the center of the cable drum to provide lubrication for the moving parts and cooling oil for the brake. Oil enters at port 70 and leaves at port 71.

While the preferred embodiment of the invention has been described it should be understood that variations will be apparent to one skilled in the art without departing from the principles therein. Accordingly the invention is not to be limited to the specific embodiment illustrated in the drawing.

The embodiments of the invention in which a particular property or privilege is claimed are defined as follows:

1. A self-regulating brake mechanism for a hoisting winch of the type having a drum for supporting a load, a reversible input shaft driven by a motor, an output drive coupled to the drum, and spring applied normally engaged brake means for locking the drum against lowering when a load is raised and for controlling the speed of the drum when a load is lowered, the improvement comprising:

said output drive including an output shaft aligned with said input shaft and a planetary drive train, clutch means in said planetary drive train for providing movement of the drum in a hoist direction independent of said brake means in response to rotation of the input shaft in a first direction but locked to said brake during rotation of the input shaft in the opposite second direction, and brake release means for releasing the brake in response to rotation of the input shaft in the opposite second direction, said brake means including friction means engaged for braking the output drive, said brake means including brake actuator means for engaging said friction means and being releasable to disengage said friction means, said brake release means including a plurality of opposed ramps circumferentially spaced around an axis coincident to said input and output shafts and operatively joined to said shafts with the ramps being angled from a first point axially toward said output shaft to a second point axially toward said input shaft when viewed in cross section across said coincident axes, a plurality of balls between said ramps, and spring means for pushing said ramps toward one another, and wherein relative displacement of the ramps over said balls by rotation of said input shaft in saidd opposite second direction causes movement of said brake actuator means for disengaging said friction means to release said brake.

2. The mechanism of claim 1, said ramps terminating in blocked ends at said second points, said blocked ends precluding movement of the balls along the ramps when the input shaft is rotated in said first direction whereby rotation of the input shaft in said first direction drives said drum through the balls, ramps and said clutch means, but rotation of the input shaft in said second direction releases said brake by rolling said ramps along said balls.

3. The mechanism of claim 2, said ramps having angled ball engaging surfaces for providing a smooth uniform loading to overcome said brake applying spring.

4. The mechanism of claim 2, said brake release means including an axially movable ramp flange, spline means connecting the ramp flange to the input shaft, a bearing engaging said ramp flange, said brake friction means including a plurality of discs, a brake piston, second spring means for pressing said brake piston against said discs to set the brake, said bearing engaging the brake piston whereby axial movement of the ramp flange by movement of said balls along said ramps moves the bearing against the brake piston to reduce the force applied by said second spring means.

5. A self-regulating brake mechanism for a hoisting winch of the type having a drum for supporting a load, a reversible input shaft driven by a motor, an output drive coupled to the drum, and brake means for locking the drum against lowering when a load is raised and for controlling the speed of the drum when a load is lowered, including spring means for normally engaging said brake means with a set maximum braking force, the improvement comprising:

said output drive including an output shaft and a drive train, one-way clutch means in said drive train for providing free-running movement of the drum in a hoisting direction while the brake remains fully engaged by bypassing said brake means in response to rotation of the input shaft in said hoisting direction but locked to said brake means when the output shaft is rotated in the opposite lowering direction, and brake release means operatively associated with said brake means and with said input shaft for releasing the brake means by withdrawing said spring means braking force in direct response to the torque of the input shaft in the opposite lowering direction.

6. The mechanism of claim 5, said brake means including a plurality of friction plates, said spring means pressing said friction plates together for braking, said brake release means including a brake actuator for releasing said plates by withdrawing said spring means braking force and means for directly converting rotational torque of said input shaft in said opposite lowering direction into axial displacement of said brake actuator for releasing said friction plates.

7. The mechanism of claim 6, wherein said converting means includes at least one surface inclined in a direction parallel to the axis of rotation of said input shaft, and force transferring means movable along said inclined surface, axially displaced thereby and coupled to said brake actuator for transferring said rotational movement of the input shaft in said opposite lowering direction into axial displacement of the brake actuator for releasing the friction plates.

8. The mechanism of claim 7, said converting means including a plurality of circumferentially spaced inclined surfaces, wherein said force transmitting means movable along the inclined surface includes a plurality of balls and a plurality of opposed second inclined surfaces with the balls being sandwiched between said inclined surfaces.

* * * * *